US007845047B2

(12) United States Patent
Loftis

(10) Patent No.: US 7,845,047 B2
(45) Date of Patent: Dec. 7, 2010

(54) CLEANING BRUSH

(75) Inventor: Tony Loftis, Oakland, TN (US)

(73) Assignee: The ServiceMaster Company, Memphis, TN (US)

( * ) Notice: Subject to any disclaimer, the term of this patent is extended or adjusted under 35 U.S.C. 154(b) by 668 days.

(21) Appl. No.: 11/798,541

(22) Filed: May 15, 2007

(65) Prior Publication Data

US 2008/0283093 A1 Nov. 20, 2008

(51) Int. Cl.
*A47L 5/00* (2006.01)
*A47L 9/06* (2006.01)

(52) U.S. Cl. ..... 15/398; 15/396

(58) Field of Classification Search ..... 15/396, 15/398
See application file for complete search history.

(56) References Cited

U.S. PATENT DOCUMENTS 1,053,665 A * 2/1913 Spencer ..... 15/415.1
1,107,715 A * 8/1914 Sharpneck ..... 15/396
1,488,814 A 4/1924 Hahn, Jr.
1,491,261 A * 4/1924 Harford ..... 15/397
1,628,291 A 5/1927 Weber
1,697,855 A * 1/1929 Cusenza ..... 110/349
D99,364 S 4/1936 Paisley
2,243,120 A * 5/1941 Pollitt ..... 15/395
D127,804 S 6/1941 Kahn
2,276,944 A * 3/1942 Dow ..... 15/397
2,795,807 A 5/1957 Salvy ..... 15/176
2,866,221 A * 12/1958 Warva ..... 15/397
3,065,491 A * 11/1962 Amador ..... 15/396
3,128,487 A 4/1964 Vallis ..... 15/176
3,315,296 A 4/1967 Richardson ..... 15/159
3,800,359 A * 4/1974 Howard et al. ..... 15/37
3,835,869 A * 9/1974 Newman et al. ..... 132/271
4,161,050 A * 7/1979 Sasaki et al. ..... 15/207.2
4,373,224 A 2/1983 Bandai et al. ..... 15/1.5 A
5,063,635 A 11/1991 Ishii et al.
5,345,651 A * 9/1994 Roberts ..... 15/397
5,479,951 A 1/1996 Denebeim ..... 132/265
5,832,559 A 11/1998 Kang ..... 15/416
6,094,776 A 8/2000 Fish
6,341,611 B1 1/2002 Nakamura ..... 132/120
6,370,731 B1 * 4/2002 Carter ..... 15/393
6,484,357 B1 11/2002 Dong
D468,108 S 1/2003 Yu ..... D4/128
6,739,016 B2 5/2004 Bigio ..... 15/160
6,817,053 B2 11/2004 Nakamura ..... 15/160
D518,297 S * 4/2006 Little ..... D4/133
D547,068 S * 7/2007 Major ..... D4/136
2001/0001887 A1 5/2001 Bigio ..... 15/159.1
2002/0066150 A1 6/2002 Bigio ..... 15/160
2004/0078913 A1 4/2004 Bigio ..... 15/160
2004/0088811 A1 5/2004 Bigio ..... 15/160
2007/0056138 A1 3/2007 Baan et al.
2009/0133203 A1 * 5/2009 Loftis ..... 15/1

FOREIGN PATENT DOCUMENTS

FR 2015132 4/1970
JP 11033072 A * 2/1999

* cited by examiner

*Primary Examiner*—Bryan R Muller

(57) ABSTRACT

A brush for dusting and cleaning includes a handle having a first end and a second end, an outer rail of bristles along an outer portion of the brush having a first row of outer bristles and a second row of outer bristles; an inner rail of bristles along an inner portion of the brush having a first row of inner bristles and a second row of inner bristles; at least one row of suction holes located between the first row of outer bristles and the second row of outer bristles to remove materials trapped within the brush; and a front row of bristles located along the second end of the handle.

20 Claims, 4 Drawing Sheets

CLEANING BRUSH

FIELD OF THE INVENTION

The present invention relates generally to a cleaning brush. More particularly, the present invention relates to a brush that can be attached to a vacuum and is designed to concurrently stir up and trap dust.

BACKGROUND OF THE INVENTION

Dust and other debris frequently accumulate on surfaces in offices, homes and other human environments. Dust often attracts dust mites, which flourish in the fibers of bedding, furniture, and carpets. Enzymes used by the dust mites to digest dust particles and their feces, become part of house dust and can provoke allergic reactions in humans. In fact, dust mites are considered to be the most common cause of asthma and allergic symptoms worldwide.

For aesthetic and health-related reasons, a myriad of methods of removing dust and debris have been developed. These methods include wiping, swiping, or sweeping by hand, or with a dust cloth, sponge, duster, or broom, or by suction by a vacuum cleaner or air filter. One such method includes the use of a bristled brush which is used to sweep the dust to a location to be later collected using some appropriate device such as a dustpan. A major disadvantage of these previous methods of removing dust is that often, the dust must first be swept to a desired location and then separately, utilizing an additional cleaning step and/or device to collect the dust.

Because dust and other debris that frequently accumulate in offices, homes and other human environments can easily become airborne, care must be exercised when removing dust, as the activity intended to sanitize or remove dust may easily make it airborne. Previous devices and methods of removing dust are often inefficient because while attempting to trap up the dust particles, dust particles frequently become airborne and resettle onto surfaces in the environment. Additionally, the activity can be somewhat hazardous because dust particles may come to settle in the cleaner's lungs. Preventing the inhalation of dust particles is especially critical for individuals having asthma and/or allergies.

Accordingly, it is desirable to provide a method and apparatus for simultaneously trapping and collecting dust particles in a central location while impeding the dispersion of dust particles into the air.

SUMMARY OF THE INVENTION

The foregoing needs are met, to a great extent, by the present invention, wherein in one aspect an apparatus is provided that in some embodiments provide a cleaning brush apparatus that safely gathers dust particles within gaps between its rows of bristles. Additionally, the cleaning brush apparatus may be designed especially to attach to a vacuum hose such that the cleaning brush apparatus may sweep and collect dust particles in a central location via slots located within the gaps between the rows of bristles. Example embodiments of the cleaning brush apparatus provide protective bristles which minimize damaging or scratching of a sensitive surface during dusting.

A brush for dusting and cleaning includes a handle having a first end and a second end. In example embodiments of the present invention, the first end of the handle may be attached to a vacuum. The example embodiments of the brush apparatus also include an outer rail of bristles along an outer portion of the brush having a first row of outer bristles and a second row of outer bristles. The brush may also include an inner rail of bristles along an inner portion of the brush having a first row of inner bristles and a second row of inner bristles. The brush may include 2-3 or more rows of inner bristles. The outer and inner rails of bristles may be configured to make the materials airborne. Each row or outer an inner bristles may include a plurality of bundles of horse hair bristles or synthetic bristles. The bristles in the center of each bundle may include strands of bristles that are approximately between 1.5 and 3.5 inches long.

In example embodiments, at least one row of suction holes located between the first row of outer bristles and the second row of outer bristles may be used to aid the removal of materials trapped within the brush. The at least one row of suction holes may include a first row of suction holes located between the first row of outer bristles and the first row of inner bristles, a second row of suction holes located between the second row of outer bristles and the second row of inner bristles and a third row of suction holes located between the first and second rows of inner bristles. The rows of suction holes may be staggered with respect to one another. Each suction hole may additionally include a plurality of sloped ridges adjacent to the suction holes. To account for the venturi effect, the suction holes closer to the first end of the handle are smaller than those at the second end. In example embodiments, each row of suction holes may include 3 suction holes and these holes may have a length of 0.9, 1.0 and 1.1 inches, respectively.

It is contemplated that the handle may be made of wood, plastic, steel aluminum, a combination thereof or other suitable materials. The handle may be 7-21 inches long. To protect the surfaces during dusting and cleaning, a front row of bristles, which includes, for example, at least two frontal bristles, is located along the second end of the handle. In example embodiments, the front row of bristles includes bristles that angularly protrude from the handle forming an angle other than 90 degrees.

Another embodiment of the invention provides a method for using a brush for dusting and cleaning, including: attaching a brush to a vacuum, wherein the brush includes a handle, an outer row of bristles, an inner row of bristles and at least one row of suction holes adjacent the inner row of bristles; applying the brush to a surface to be dusted and cleaned; collecting materials within the outer and inner rows of bristles; and suctioning the materials into the at least one row of suction holes. The method could further include protecting the surface by applying the brush having a front row of bristles.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
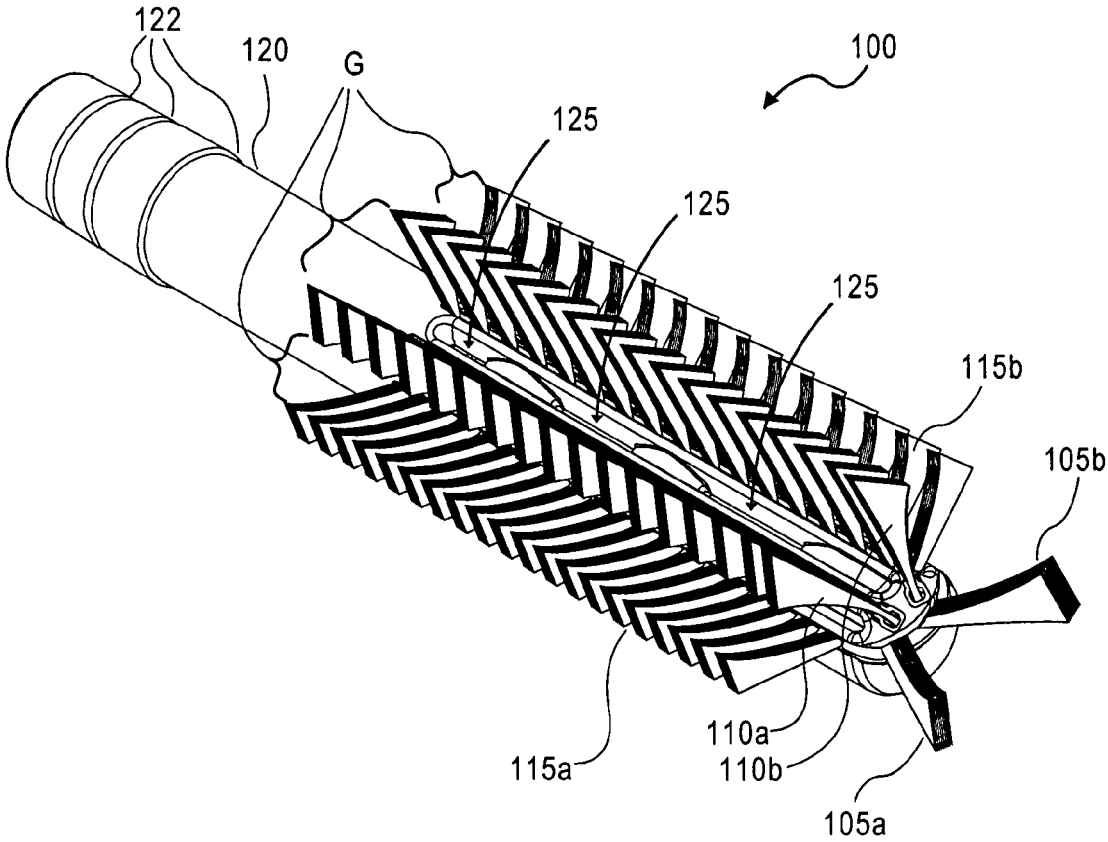
FIG. 1 is a bottom perspective view illustrating a cleaning brush apparatus according to an example embodiment of the present invention.

Example embodiments of the present invention provide a cleaning apparatus that allows for dirt and dust to be swept into gaps between rows of bristles, which are attached to a handle via metal rails. In example embodiments, the dust is concurrently collected into a row of suction holes without requiring separate steps to sweep and collect the dust. As such, the spacing of the inner and outer bristles allows for dust to be trapped in the gaps rather than permanently dispersing into the breathing air. Additionally, surfaces are unlikely to be damaged during dusting because protective frontal bristles prevent the handle from contacting and scratching the surfaces. The invention will now be described with reference to the drawing figures, in which like reference numerals refer to like parts throughout.

An embodiment of the present inventive cleaning brush apparatus is illustrated in FIG. 1. Example embodiments of the present invention provide a cleaning brush apparatus 100 having a handle 120 suitable for attaching the apparatus 100 to a vacuum (not shown) and rows of bristles 110*a*, 110*b*, 115*a* and 115*b*. Dirt and dust are conducted into the gaps G located between the rows of bristles 110*a*, 110*b*, 115*a* and 115*b*.

In example embodiments, the cleaning brush apparatus 100 has a row of center suction holes 125 within the gap G, located in between the inner rows of bristles 110*a* and 110*b*. In example embodiments, the rows of bristles 110*a*, 110*b*, 115*a* and 115*b* are pointed away from the row of center suction holes 125. The handle 120 can also include grooves 122 at one end of the brush apparatus 100 for aiding the mating of the apparatus 100 to a vacuum hose (not shown).

In example embodiments of the present invention, the cleaning brush apparatus 100 also has front bristles 105*a* and 105*b*, as shown in FIG. 1. Because the frontal bristles 105*a* and 105*b* are pointed out, the handle 120 is significantly less likely to contact the surfaces as dust is removed from them. For this reason, the front bristles 105*a* and 105*b* point out forming an angle other than a 90 degree angle with respect to the handle 120. Although shown with two front bristles, the invention can include one or more front bristles for preventing the handle from scratching surfaces during dusting. In example embodiments, for example, the cleaning brush apparatus may include at least two frontal bristles.

Figure 2:
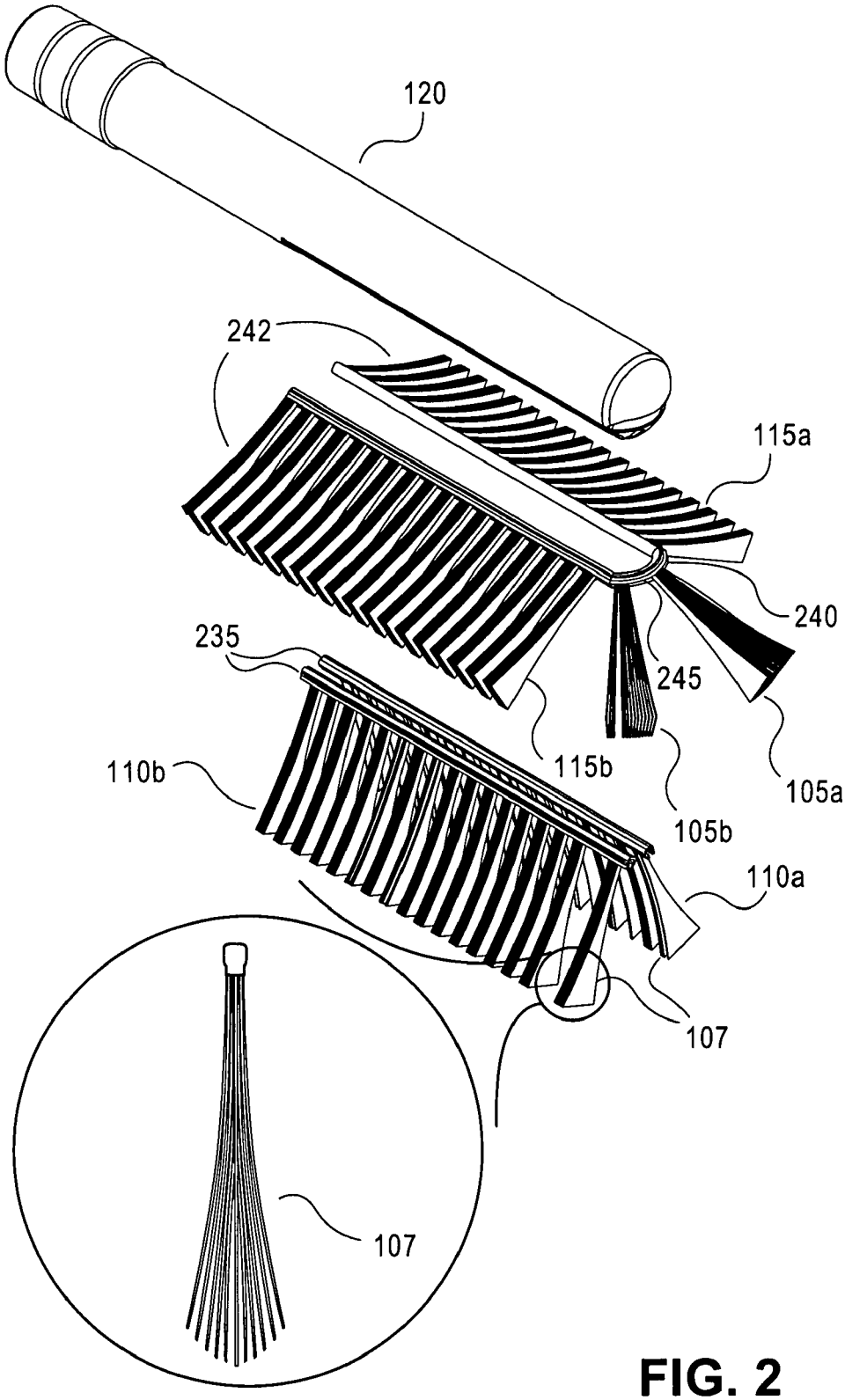
FIG. 2 is an exploded view of the individual components of the cleaning brush apparatus of FIG. 1.

An exploded view of the individual components of the cleaning brush apparatus 100 in accordance with the present invention is illustrated in FIG. 2. In example embodiments of the present invention, two rails of bristles may be attached to the handle 120: at least one inner rail of bristles 235 and an outer rail of bristles 240, as shown in FIG. 2. The at least one inner rail of bristles 235 may include a row of bristles 110*b* or 110*a*, which attach at an angle such that, when the inner rail of bristles 235 is attached to the handle 120, the bristles point away from the row of center suction holes 125. In other embodiments, the brush apparatus 100 may also include 3 or more inner rails of bristles 235.

In example embodiments of the present invention, the outer rail of bristles 240 includes two outer sections of bristles 242, which each resemble the at least one inner rail of bristles 235. However, the outer sections of bristles 242 are more angled than inner rail of bristles 235 in order to maintain a wide gap G between rows of bristles 110*a* and 115*a* and between rows of bristles 110*b* and 115*b*. It is desirable to maintain an approximately one-half-inch gap G between the rows of bristles. However, gaps between ¼ inch or less and 1 inch or more are within the embodiments of the invention. The outer rail of bristles 240 also includes a curved rail portion 245 which connects the two outer sections of bristles 242. Front bristles 105*a* and 105*b* protrude from the curved rail portion 245.

In accordance with example embodiments of the present invention, the rails of bristles 235, 240 and 245 may be made of aluminum, galvanized steel or other suitable metal material. In preferred embodiments the metal for rails 235 and 240 may be provided at approximately 7-8 inches in length. The metal for the curved rail portion 245 may be approximately less than one-inch in length. Bristles may be attached by positioning the bristles in a desired position and then crimping down on the metal to hold the bristles in the position. The outer and inner rails of bristles may be configured to make the materials of debris airborne during dusting and cleaning.

In example embodiments of the present invention, the rows of bristles 110*a*, 110*b*, 115*a* and 115*b* may include bristles made of strands of horse hair or synthetic or other suitable material. Each row may be comprised of a plurality of bundles of horse hair bristles 107, as shown in FIG. 2. The bundles of horse hair bristles 107 may be cut such that the inner strands in the center of each bundle are, for example, approximately 2.5 inches, while the outer strands are cut slightly shorter, as shown in FIG. 2. In other example embodiments, longer strands approximately between 1.5 and 3.5 inches long are also contemplated. In example embodiments, the bundles of horse hair bristles 107 may be separated by approximately 0.1-0.9-inch gaps. In example embodiments, the gaps between bundles 107 are approximately 0.2-inches. As such, in these embodiments, the sections of horse hair bristles 107 may be described as tufted bristles cut in an alternating arrangement.

Figure 3:
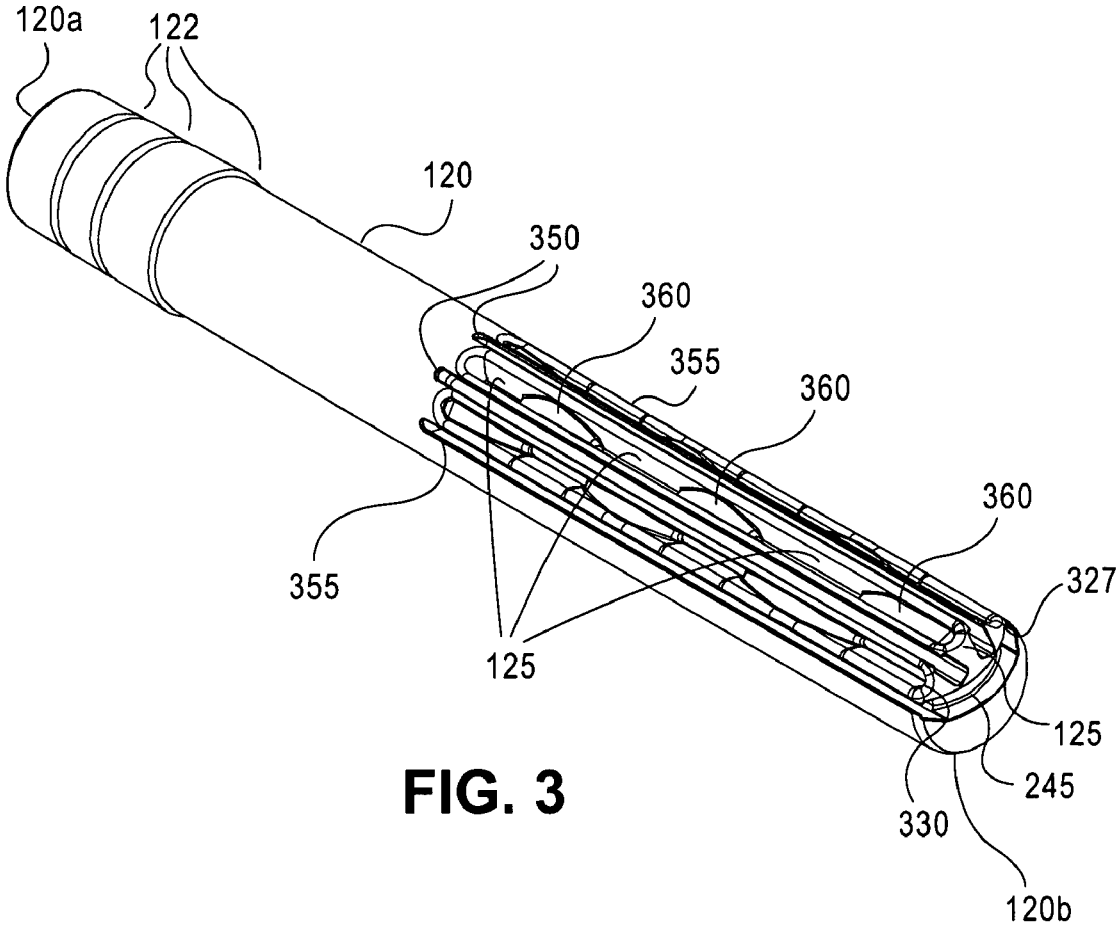
FIG. 3 is a detail view of a handle of a cleaning brush according to another embodiment of the invention.

A handle 120 in accordance with example embodiments of the present invention is illustrated in FIG. 3. In example embodiments, the handle may be manufactured from wood, steel, aluminum, plastic, or a combination thereof or another material suitable for use as a vacuum hose attachment or as a stand-alone brush. The handle 120 for use with a vacuum hose attachment may include grooves 122 for aiding the mating of the handle 120 with the hose attachment. A handle 120 in accordance with the present invention may be approximately 7-21 inches long. For example, the handle 120 may be 14 inches long.

In example embodiments of the present invention, the handle 120 may include inner rail attachments 350 for inner rail of bristles 235 and outer rail attachments 355 for outer rail of bristles 240. The inner 235 and outer rails of bristles 240 may be slid in and out of inner 350 and outer rail attachments 355. This configuration of removable rails of bristles enables selective replacement of damaged rows of bristles, which allows for cheaper maintenance of the brush apparatus 100 because only rows that need be replaced need be discarded.

In accordance with preferred embodiments, the handle 120 has a row of center suction holes 125, discussed above, which is located between the two inner rail attachments 350. In example embodiments, the handle 120 also has an outer row of suction holes 327, located between one inner rail attachment 350 and one outer rail attachment 355. Example embodiments of the handle 120 has another outer row of suction holes 330, located between the other inner rail attachment 350 and outer rail attachment 355. In example embodiments, each row of suction holes 125, 327 and 330 has three sets of suction holes of different shapes and sizes. Additionally, the handle may have a plurality of sloped ridges 360 which are curved portions that slope inward towards the suction holes 125, 327 and 330 such that the dust is easily suctioned into the holes.

In preferred embodiments of the invention, the vacuum (not shown) is attached at the proximate end 120*a* of the handle 120. The vacuum is furthest from the distal end 120*b* of the handle 120. Accordingly, the vacuum provides more suction power at suction holes located closest to the proximate end 120*a* of the handle 120. To account for this venturi effect, which causes a decrease in suction power for holes further away from the vacuum, within each row of suction holes, 125, 327 and 330, the suction holes that are closer to the distal end 120*b* of the handle 120 may be larger to provide better suction of dust particles. In example embodiments, the suction holes located closest to the proximate end 120*a* of the handle 120 are smallest because the suction power at that location is strongest. Thus, the suction holes increase in size as each row of holes 125, 327 and 330 approach the distal end 120*b*. For instance, the row of suction holes 125 may include 3 holes wherein: the hole closest to the proximate end 120*a* is 0.9 inches; the middle hole is 1 inch in length, and; the hole closest to the distal end 120*b* is 1.1 inches. In other embodiments, the suction holes in rows 125, 130 and 330 may be aligned with each other or alternatively, staggered in relation to each other, as shown in FIG. 3.

Figure 4:
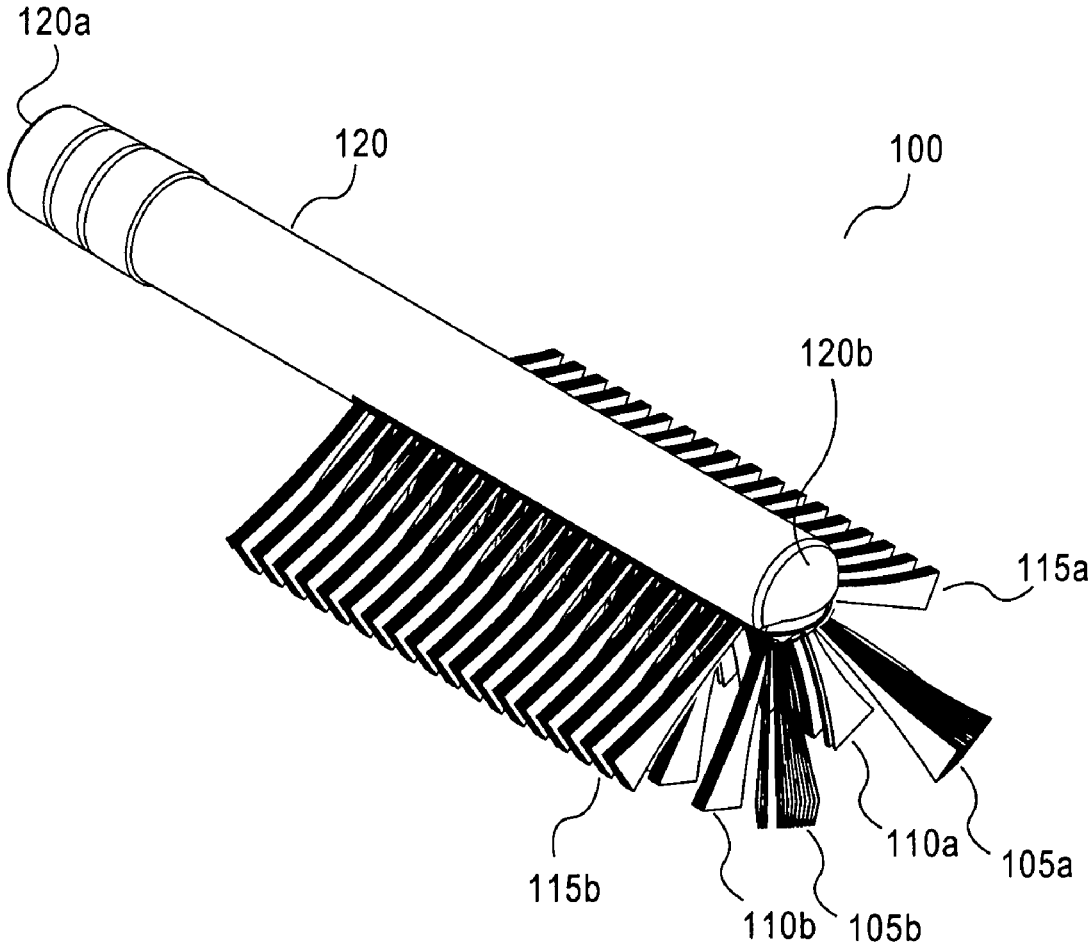
FIG. 4 is a top perspective view of the cleaning brush apparatus of FIG. 1.

The cleaning brush apparatus 100 may be attached to a vacuum and applied to surfaces to remove dust particles and other small debris. When in use, the top end of the handle is visible, as shown in FIG. 4, and the ends of the bristles contact a surface to be dusted at an angle. The outer and inner rails of bristles may be configured to make the particles and debris airborne. The rows of bristles 110*a*, 110*b*, 115*a* and 115*b* stir up dust which becomes trapped in the gaps G. The dust is then collected by the vacuum (not shown) via suction holes in rows 125, 327 and 330. The frontal bristles 105*a* and 105*b* protect surfaces during dusting by preventing the handle 120 from contacting surfaces at its distal end 120*a*.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A brush for dusting and cleaning, comprising:

a handle having a first end and a second end and a hollow interior;

an outer rail of bristles along an outer portion of the brush having a first row of outer bristles and a second row of outer bristles;

an inner rail of bristles along an inner portion of the brush having a first row of inner bristles and a second row of inner bristles;

a first row of suction holes located between the first row of outer bristles and the second row of outer bristles to remove materials trapped within the brush;

a first sloped ridge separating a first hole and a second adjacent hole of the first row of suction holes, the sloped ridge having a first curved portion adjacent to the first hole that slopes from an outer portion of the handle toward the hollow interior of the brush at the first hole and a second curved portion adjacent to the second hole that slopes from an outer portion of the handle toward the hollow interior of the brush at the second hole such that dust is easily suctioned into the holes; and a front row of bristles located along the second end of the handle.

2. The brush for dusting and cleaning, as claimed in claim 1, wherein the first end of the handle is configured for attachment to a vacuum.

3. The brush for dusting and cleaning, as claimed in claim 1, wherein the handle is comprised of a material chosen from wood, plastic, steel aluminum or a combination thereof.

4. The brush for dusting and cleaning, as claimed in claim 1, wherein the handle is approximately between 7-21 inches long.

5. The brush for dusting and cleaning, as claimed in claim 1, wherein the outer rail of bristles is u-shaped and comprises a first longitudinal portion, a second longitudinal portion and a curved portion, wherein the curved portion has a curvature matching a shape of the second end of the handle.

6. The brush for dusting and cleaning, as claimed in claim 1, wherein the outer and inner rails of bristles include a plurality of bundles of bristles which are configured to make the materials airborne.

7. The brush for dusting and cleaning, as claimed in claim 1, wherein the front row of bristles includes at least two frontal bristles.

8. The brush for dusting and cleaning, as claimed in claim 1, wherein:

the first row of suction holes is located between the first row of outer bristles and the first row of inner bristles;

a second row of suction holes is located between the second row of outer bristles and the second row of inner bristles; and a third row of suction holes is located between the first and second rows of inner bristles.

9. The brush for dusting and cleaning, as claimed in claim 8, wherein the suction holes within the first, second and third rows are staggered in relation to each other.

10. The brush for dusting and cleaning, as claimed in claim 1, wherein each row of inner bristles and outer bristles includes a plurality of bundles of horse hair bristles.

11. The brush for dusting and cleaning, as claimed in claim 1, wherein each row of inner bristles and outer bristles includes a plurality of bundles of synthetic bristles.

12. The brush for dusting and cleaning, as claimed in claim 1, wherein each row of inner bristles and outer bristles includes center bristles of approximately between 1.5 and 3.5 inches in length.

13. The brush for dusting and cleaning, as claimed in claim 1, wherein the front row of bristles includes bristles that angularly protrude from the handle forming an angle other than 90 degrees.

14. The brush for dusting and cleaning, as claimed in claim 8, additionally comprising a second sloped ridge disposed between a first hole and a second hole of the second row of suction holes and a third sloped ridge disposed between a first hole and a second hole of the third row of suction holes.

15. The brush for dusting and cleaning, as claimed in claim 1, wherein suction holes closer to the first end of the handle are smaller than the suction holes closer to the second end of the handle.

16. The brush for dusting and cleaning, as claimed in claim 1, further comprising a second row of suction holes and a third row of suction holes.

17. The brush for dusting and cleaning, as claimed in claim 16, wherein each row of suction holes includes holes of approximately 0.9, 1.0, and 1.1 inches in length.

18. A brush for dusting and cleaning, comprising:

a handle having a first and second end and a hollow interior, wherein the first end of the handle is configured for attachment to a vacuum hose;

an outer rail of bristles along an outer portion of the brush having a first row of outer bristles and a second row of outer bristles;

an inner rail of bristles along an inner portion of the brush having a first row of inner bristles and a second row of inner bristles;

a row of suction holes located between the first row of outer bristles and the second row of outer bristles to remove materials trapped within the brush;

a sloped ridge separating a first hole and a second adjacent hole of the row of suction holes, the sloped ridge having a first curved portion adjacent to the first hole that slopes from an outer portion of the handle toward the hollow interior of the brush at the first hole and a second curved portion adjacent to the second hole that slopes from an outer portion of the handle toward the hollow interior of the brush at the second hole such that dust is easily suctioned into the holes; and a front row of bristles located along the second end of the handle.

19. The brush for dusting and cleaning, as claimed in claim 18, wherein the outer and inner rails of bristles include a plurality of bundles of bristles which are configured to make the materials airborne.

20. The brush for dusting and cleaning, as claimed in claim 18, wherein suction holes closer to the first end of the handle are smaller than the suction holes closer to the second end of the handle.

* * * * *